US010435193B2

(12) United States Patent
Moon

(10) Patent No.: US 10,435,193 B2
(45) Date of Patent: Oct. 8, 2019

(54) STORAGE BOX

(71) Applicant: Brian Moon, Sycamore, IL (US)

(72) Inventor: Brian Moon, Sycamore, IL (US)

( * ) Notice: Subject to any disclaimer, the term of this patent is extended or adjusted under 35 U.S.C. 154(b) by 224 days.

(21) Appl. No.: 14/602,269

(22) Filed: Jan. 21, 2015

(65) Prior Publication Data

US 2018/0141697 A1 May 24, 2018

Related U.S. Application Data

(60) Provisional application No. 61/929,736, filed on Jan. 21, 2014.

(51) Int. Cl.

| | |
|---|---|
| ***B65D 1/22*** | (2006.01) |
| ***B65D 21/04*** | (2006.01) |
| ***B65D 21/02*** | (2006.01) |
| ***B65D 43/12*** | (2006.01) |
| ***B65D 55/02*** | (2006.01) |
| ***B65D 25/28*** | (2006.01) |

(52) U.S. Cl.

CPC ..... *B65D 1/22* (2013.01); *B65D 21/0201* (2013.01); *B65D 21/0212* (2013.01); *B65D 21/0216* (2013.01); *B65D 21/0223* (2013.01); *B65D 21/04* (2013.01); *B65D 25/28* (2013.01); *B65D 43/12* (2013.01); *B65D 55/02* (2013.01); *B65D 2543/00027* (2013.01); *B65D 2543/00398* (2013.01); *B65D 2543/00648* (2013.01); *B65D 2555/02* (2013.01)

(58) Field of Classification Search

CPC .. B65D 1/22; B65D 21/0212; B65D 21/0201; B65D 21/0216; B65D 21/0223; B65D 21/04; B65D 21/041; B65D 25/28; B65D 43/12; B65D 43/20; B65D 5/646; A47C 17/86

USPC ..... 220/812, 811, 810, 783, 780, 657, 658, 220/656; 5/308; 312/122, 117, 119

See application file for complete search history.

(56) References Cited

U.S. PATENT DOCUMENTS

| | | | | | |
|---|---|---|---|---|---|
| 2,854,676 | A * | 10/1958 | Fried | A47C 17/86 | 5/308 |
| 3,647,102 | A * | 3/1972 | Cooley | B65F 1/06 | 220/345.1 |
| 4,405,057 | A | 9/1983 | Stein | | |
| 4,917,254 | A * | 4/1990 | Ciriacks | B65F 1/14 | 206/205 |
| 5,070,556 | A * | 12/1991 | Gloger | A47C 17/86 | 16/35 R |
| 5,328,049 | A * | 7/1994 | Ritzow | A01K 63/003 | 119/481 |
| 5,860,527 | A | 1/1999 | Frankenburg et al. | | |
| 6,595,381 | B1 * | 7/2003 | Johnson | A45C 5/04 | 220/345.1 |

(Continued)

*Primary Examiner* — Robert J Hicks

(74) *Attorney, Agent, or Firm* — James D Palmatier; Applied Patent Services, PC

(57) ABSTRACT

A storage box for property storage having an open box side surrounded by an upper edge and closed by a lid engaged to the box edges to prevent the box from disengaging from the lid. The lid surroundingly engaging the upper edge of the box along a horizontal box flange around the perimeter of the open box side. A vertical box flange on three sides of the horizontal box flange surrounding the upper edge. A lid on the storage box. The lid having a box edge rail engagement for surroundingly and removably engaging the vertical box flange of the storage box.

21 Claims, 6 Drawing Sheets

(56) References Cited

U.S. PATENT DOCUMENTS

| | | | |
|---|---|---|---|
| 6,874,650 | B2 | 4/2005 | Welsh et al. |
| 2010/0108556 | A1 | 5/2010 | Claffy |

* cited by examiner

STORAGE BOX

This application is a continuation of U.S. Provisional Application Ser. No. 61/929,736 filed Jan. 21, 2014 and claims the benefit of the filing date of said provisional Application Ser. No. 61/929,736

FIELD OF THE INVENTION

The present invention relates to a stackable, nestable storage box for use in securing personal items by people living in group settings. The box has a lockable, removable lid adapted to resist removal by flexing the sides of the box.

BACKGROUND OF THE INVENTION

Storage boxes or tote boxes are known in the prior art. These boxes may be made of metal, plastic or composites. The design adapts to nesting for storage and shipping and stacking, allowing one box containing material to be stacked on another. Securing the contents in the box requires a closure that resists removal. Lids used to close prior art boxes may be removed by flexing the box with the lid on to spring the lid off the box opening.

Prior art lids may be adapted to fit with features on the bottom of the box to facilitate stacking when the lid is on the box. The lids in the prior art may be removably fitted to the box top. Prior art lids may be dislodged from the top of the box by flexing the box causing the walls to disorientate and come apart from the lid.

Accordingly, it is desirable to provide a storage box having a lid which is interlocked with the open edge of the box to prevent the lid coming off of the box in the event that the boxes dropped or otherwise has the sides flexed. There is an aid to provide a storage box for intensive use applications which minimizes the use of fasteners while providing more impact-resistance, less weight and high-volume.

SUMMARY OF ONE EMBODIMENT OF THE INVENTION

The present invention comprises a storage box having a generally rectangular bottom molded with four connecting sidewalls extending away from the bottom to form an open ended box having an upper edge around the opening. A horizontal box flange extends outwardly from the box opening surrounding the box opening and interconnecting the sidewalls. The horizontal box flange extends around the perimeter of the box opening. The horizontal box flange is generally parallel with the bottom of the box and providing a surrounding ledge around the perimeter of the open top of the box. The horizontal box flange extends outwardly from the box opening. The horizontal box flange has an inside edge connected to the sidewalls and end walls of the box and an outside edge defining a flange perimeter, a top side and a bottom side.

A vertical box flange is on the outside edge of the horizontal box flange. The vertical box flange extends upward to define the upper edge of the open box opening. The vertical box flange may comprise a box portion that is continuous around three sides of the box opening and an end portion adjacent the fourth side of the box opening. A pair of rib openings are formed between the box portion and the end portion. The end portion extends along the top edge of the second end wall. The end portion has a first end that is spaced from a first end of the vertical box flange and a second end that is spaced from a second end of the vertical box flange, thereby creating the pair of rib openings in the vertical box flange at the corners between the second end wall and each of the sidewalls. The vertical box flange may be on the outer perimeter on the outer edge of the horizontal box flange directed outward away from the open box and generally perpendicular to the bottom of the box.

The rib opening is generally at the corner of the box forming a rib engagement channel on the top side of the horizontal box flange along the first and third vertical box flanges to the rib opening at each corner adjacent the second end wall.

The lid may have a generally flat panel approximately the size and shape of the open top of the box. Several bosses may be formed in the flat panel projecting outward from the inside of the box to engage indentations formed on the bottom panel to facilitate stacking and prevent shifting position when a first box is stacked on a second box having the bosses extending into the respective indentations.

The lid may further comprise a box edge rail formed on each of two opposing sides and one end. The box edge rail surroundingly engages the continuous vertical box flange to prevent the box sides from being deformed to disengage the lid from the box. A vertical surround flange may be formed on three sides of the lid to wrap around the upper edge of the box. The vertical surround flange formed on a second end of the lid and extending along each adjacent side of the lid may be disposed comprises a vertical member extending from a bottom side of the flat panel of the lid adapted to surroundingly engage the box portion of the vertical box flange. A horizontal surround flange on the vertical surround flange may be generally horizontal and adapted to slide under the horizontal box flange.

The lid may further comprise a plurality of ribs extending from the bottom surface of the lid along the first and second opposing sides. The ribs are spaced from the vertical surround flange and are disposed in a parallel orientation to the vertical surround flange and adjacent to the inside edge of the vertical surround flange. Each rib may have an engagement portion generally parallel to the lid flange vertical member and an engagement member positioned at an angle from the flange vertical member. The engagement member forming an opening between the lid flange vertical member and the engagement portion. Several ribs may be formed along each edge of the lid forming an edge channel between the several ribs and the vertical surround flange. The engagement member closest to the first end of the lid.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 1 is a bottom perspective view of the first embodiment with the lid on

FIG. 2 is a top plan view of the first embodiment with the lid on

DETAILED DESCRIPTION OF THE INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
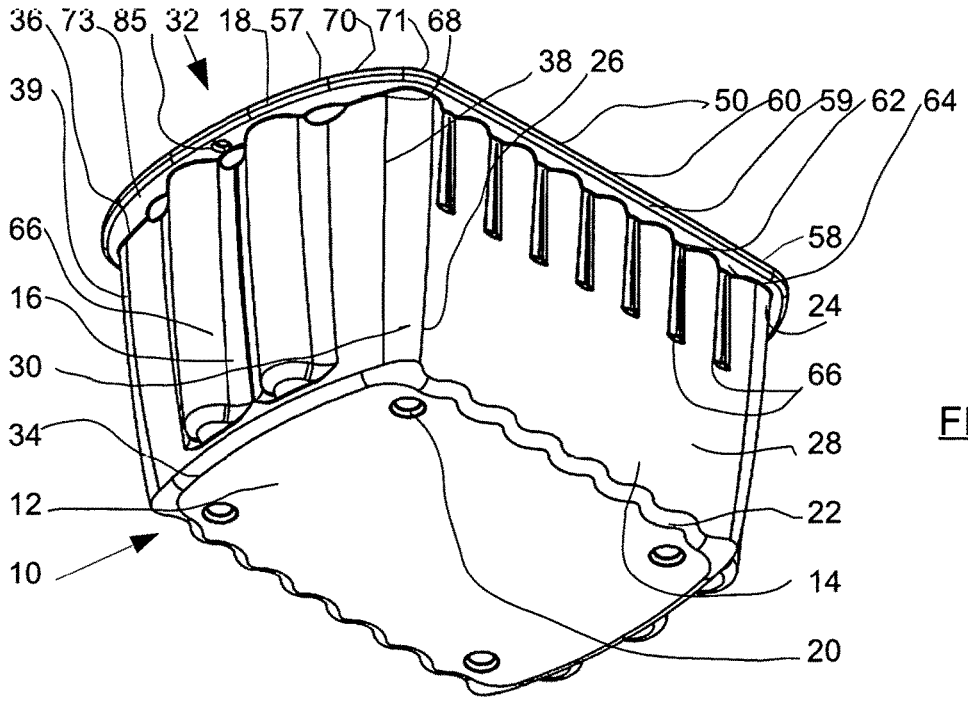

Referring to FIG. 1, the present invention comprises a storage box 10 having a generally rectangular bottom panel 12 formed with a first sidewall 14, a first end wall 16 and a top 18. The rectangular bottom 12 may have indentations 20 formed extending into the open box 10 to facilitate stacking or positioning the box 10. First sidewall 14 may have a first bottom edge 22 on bottom panel 12, a first top edge 24, a first vertical edge 26 and a second vertical edge 28. First end vertical edge 26 is attached to first end wall 16 to form a first corner 30. First top edge 24 defines the box opening 32 adjacent to first sidewall 14. First end wall 16 may have fourth bottom edge 34 on bottom panel 12, fourth top edge 36, third vertical edge 38 on second vertical edge 28 and fourth vertical edge 39. Second top edge 36 defines the open top 32 of the box 10 adjacent second end wall 16.

Figure 2:
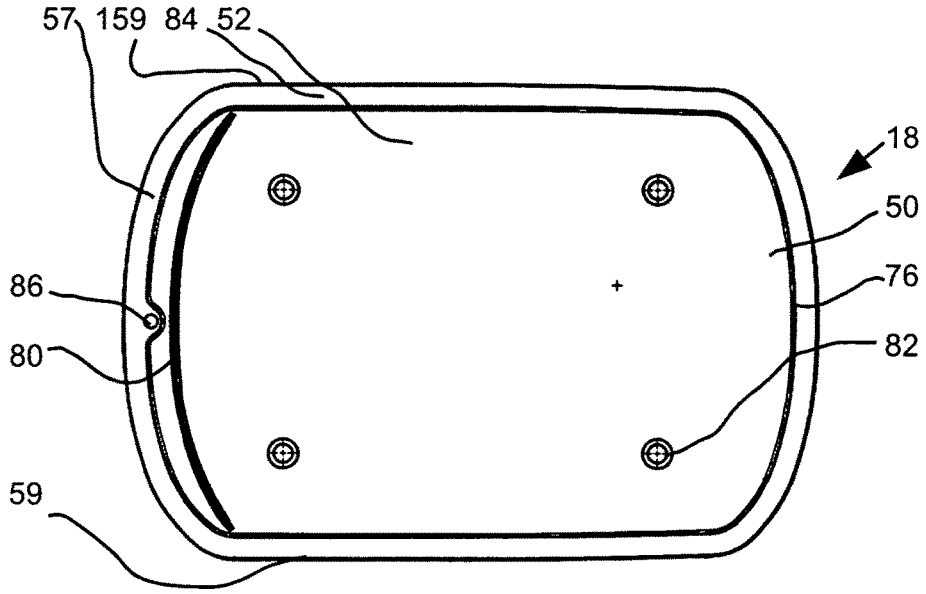

Continuing to refer to FIGS. 1 and 2, top 18 may comprise a lid 50 may be removably on the box 10. The lid 50 comprising a top shell 52 having a top side 54, a lid bottom 56, first end 57 and a first vertical surround flange 58 on the lid bottom 56, the first vertical surround flange 58 having a first side 60 on lid bottom 56 and a second side 62, a first horizontal surround flange 64 on the second side 62. Flutes 66 are formed in the first sidewall 14 and first end wall 16 adapted to support the box in a stacked or nested configuration. A horizontal box flange 68 may be continuous around open top 32. Horizontal box flange 68 is generally parallel to bottom panel 12 and extends outward from the box opening 32. Horizontal box flange 68 may have a padlock aperture 85, an outer edge 70 that defines the perimeter of the box opening 32 and a bottom side 73.

Referring to FIG. 2, lid 50 may have a top side 72, first end 57, second end 76, first side 59 and second side 159, support rib 80, a plurality of bosses 82 and outer edge 84. A padlock hole 86 is formed in the first end 57. The bosses 82 are adapted and positioned to interfit with the indentations 20 (FIG. 1).

Figure 3:
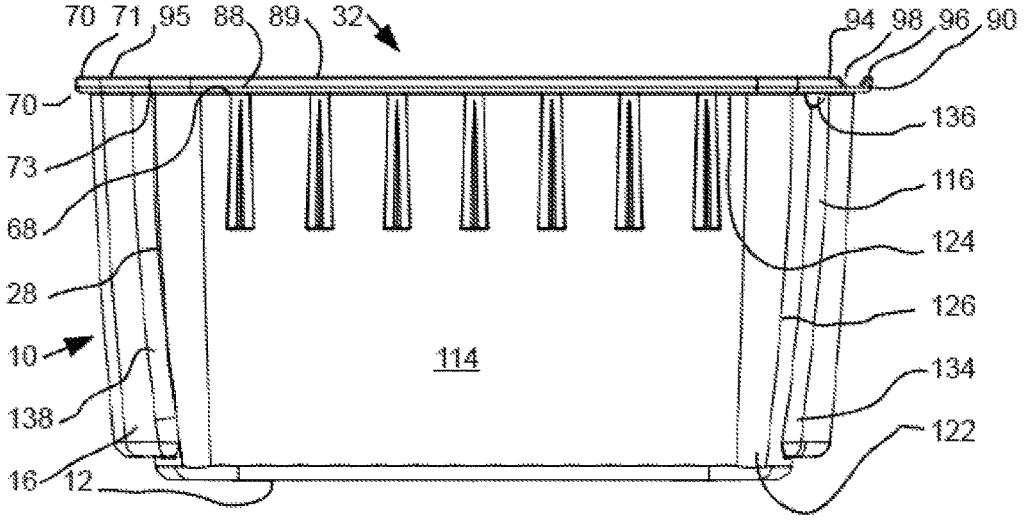
FIG. 3 is a side elevation view of the first embodiment with the lid off.

Referring to FIG. 3, box 10 further comprises a second sidewall 114 and second end wall 116. Second sidewall 114 may have a third bottom edge 122 on bottom panel 12, a third top edge 124, a fifth vertical edge 126 and a sixth vertical edge 28. Second end wall 116 may have a second bottom edge 134 on bottom panel 12, a second top edge 136, a seventh and eighth vertical edges 138, 139. First, second, third and fourth top edges 24, 36, 124, 136 are joined together to define the open top 32 of the box 10. Horizontal box flange 68 extends outwardly from the box opening 32.

Continuing to refer to FIG. 3, third vertical box flange 88 on outer edge 70 extends upward from horizontal box flange 68 adjacent second sidewall 114 to third top edge 89. First vertical box flange 90 on outer edge 70 extends upward from horizontal box flange 68 adjacent first sidewall 14 to first top edge 91. Second vertical box flange 71 having second top edge 95 is joined to third vertical box flange 88 to form a continuous flanged perimeter above first end wall 16 and second sidewall 114. Third vertical box flange 88 has a first end 94. First vertical box flange 90 has a second end 96. Rib opening 98 is formed between first end 94 and second end 96. Rib opening 98 is aligned with horizontal box flange 68 adjacent second vertical box flange 88.

Figure 4:
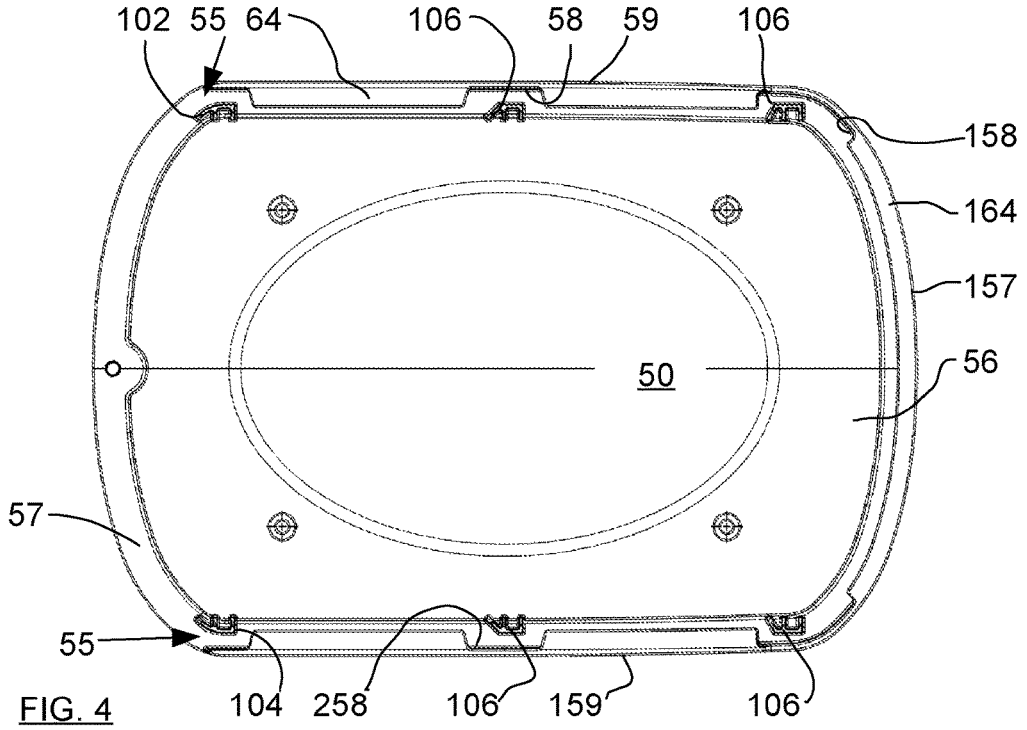
FIG. 4 is a bottom plan view of the lid of the first embodiment.

Referring to FIG. 4, lid 50 further comprises first end 57 and second end 157, first side 59 and second side 159. A box edge rail 55 may be formed on each side 59, 159 of the lid 50 extending from the lid bottom 56 to engage box 10. Box edge rail 55 may comprise first vertical surround flange 58 adjacent first side 59, second vertical surround flange 158 on lid bottom 56 along second end 157 and third vertical surround flange 258 along second side 159, each extending downward from lid bottom 56. Together vertical surround flanges 58, 158, and 258 continuously surround lid bottom 56 on three sides adjacent first and second side 59, 159 and second end 157. Lid 50 further comprises first horizontal surround flange 64 on first vertical surround flange 58 adjacent first side 59, second horizontal surround flange 164 on second vertical surround flange 158 adjacent second end 157, and third horizontal surround flange 264 on third vertical surround flange 258 adjacent second side 159.

Continuing to refer to FIG. 4, a first rib 102 is formed on lid bottom 56 adjacent to and parallel to first vertical surround flange 58. First rib 102 is spaced from first vertical surround flange 58, First vertical box flange 90 may be disposed between first vertical surround flange 58 and first rib 102 when lid 50 is on box 10. Likewise, a second rib 104 is formed on bottom side adjacent to and parallel to third vertical surround flange 258. Second rib 104 is spaced from and generally parallel to third vertical surround flange 258. First rib 102 and second rib 104 may be each a continuous rib extending downward from the bottom side 56 or may be a series of tabs 106 (FIG. 6) aligned in a linear orientation to each other.

Figure 5:
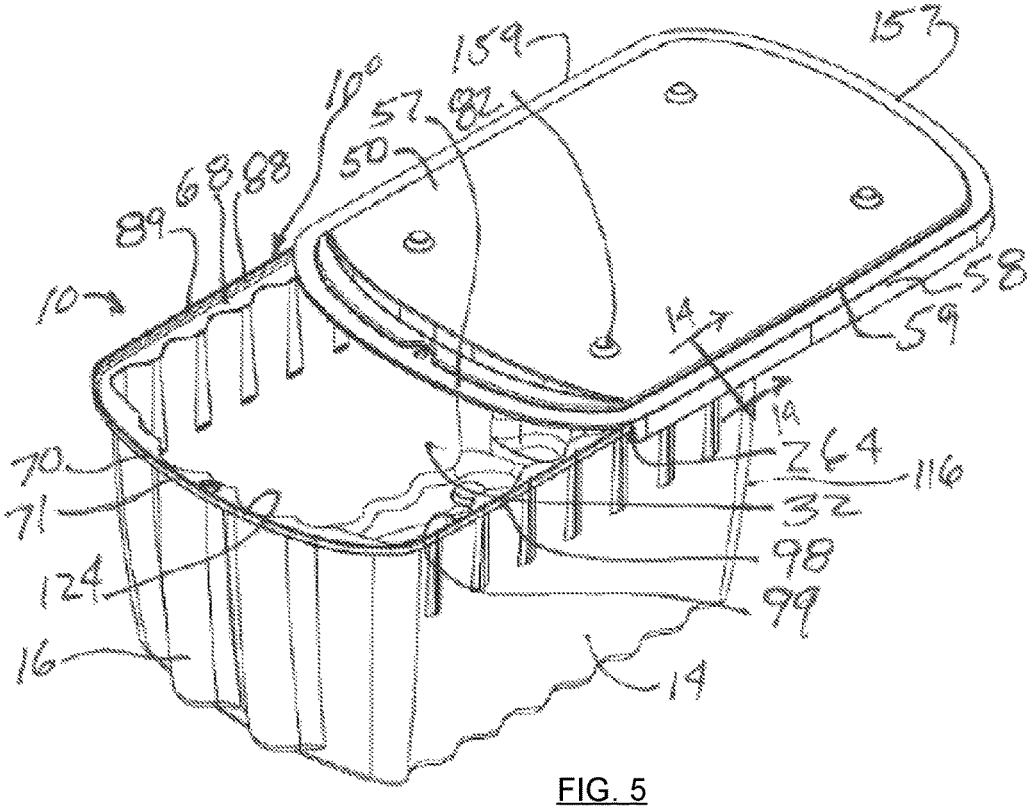
FIG. 5 is a top perspective view of the first embodiment partially open.

Referring to FIG. 5, first vertical box flange 98 is on outer edge 70 adjacent first sidewall 14. First vertical box flange 98 has top edge 99. First vertical box flange 98 may be connected to second vertical box flange 71 to form a continuous vertical box flange 71, 88, 98 around the perimeter of box opening 32 on three sides. Likewise, top edges 89, 99, 124 are connected to surround box opening 32 on three sided perimeter 100 and bear against lid bottom 56.

Figure 6:
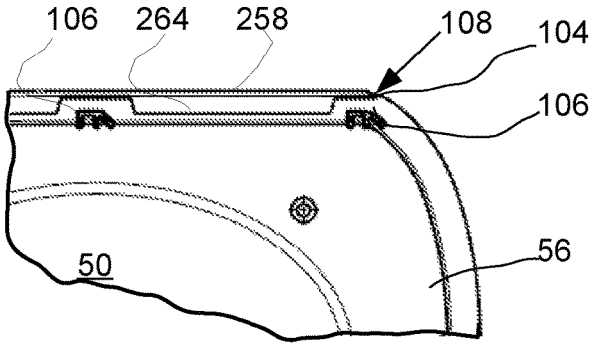
FIG. 6 is a plan view of the first end of the lid.

Referring to FIG. 6, second rib 104 may comprise tabs 106 aligned with third vertical surround flange sidewall 258 defining upper edge channel 108 on bottom surface 56 between tab 106 and third vertical surround flange 258. Horizontal surround flange 264 is generally parallel to lid 50.

Figure 7:
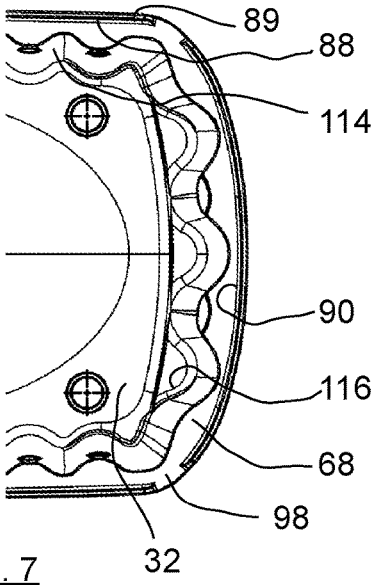
FIG. 7 is a top plan view of the first end of the box.

Referring to FIG. 7, horizontal box flange 68 may continuously surround box opening 32. The third vertical box flange 258 does not connect to second vertical box flange to form rib opening 98. A similar rib opening may be formed between first vertical box flange and second vertical box flange. First vertical box flange 90 is spaced from second vertical box flange 71 to form rib opening 98 adjacent the corner of first side 114 and second end 116. Rib opening 98 is formed to allow rib 102 to slide between third vertical surround flange 88 and box opening 32 when lid 50 is placed on box 10.

Figure 8:
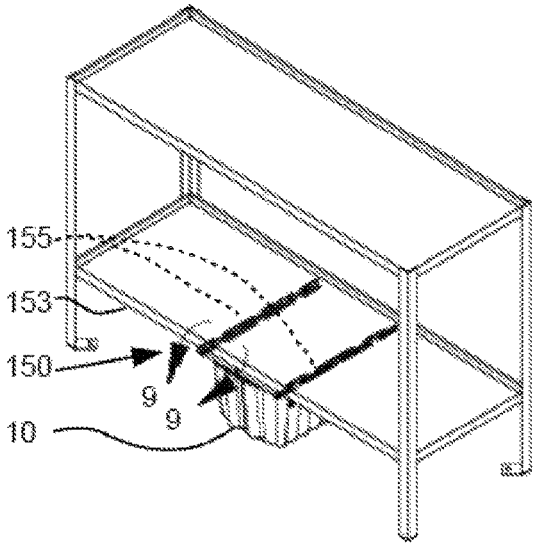
FIG. 8 is a top perspective view of a second embodiment

Referring to FIG. 8, lid 150 may be a furniture piece such as a bunk bed 153 having a bed platform with a pair of box edge rails 155 attached to the bottom to slidingly receive the box 10.

Figure 9:
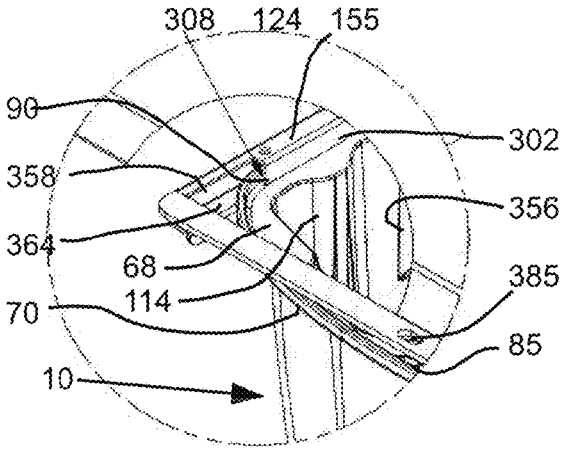
FIG. 9 is a section view taken at approximately 9-9 or FIG. 8.

Referring to FIG. 9, box edge rail 155 may comprise a vertical surround flange 358 extending downward from platform 253. Vertical surround flange 358 is disposed to be on the outside of first vertical box flange 90. Horizontal surround flange 364 extends inward toward box 10 from vertical box flange 358. Horizontal surround flange 364 is adapted to engage bottom side 73 of horizontal box flange 68 whereby first vertical box flange 90 is captured between platform 253 bottom surface 356 and horizontal surround flange 364. Rib 302 extends downward into box opening 32 from lid bottom 356. Rib 302 is adjacent to and parallel to vertical surround flange 358. Rib 302 is spaced from vertical surround flange 358 to create box channel 308 for first vertical box flange 90 to slide between rib 302 and horizontal surround flange 364. Third top edge 124 adjacent second side 114 is captured by box edge rail 155 on four sides thereby preventing the box from flexing to disengage the third top edge 124 from the box edge rail 155. It should be understood, a similar box edge rail 155 may be disposed to capture first top edge 24 (FIG. 1) is a similar fashion. Platform 253 may have a lock aperture 385 adapted to align with padlock aperture 85 in horizontal box flange 68.

Figure 10:
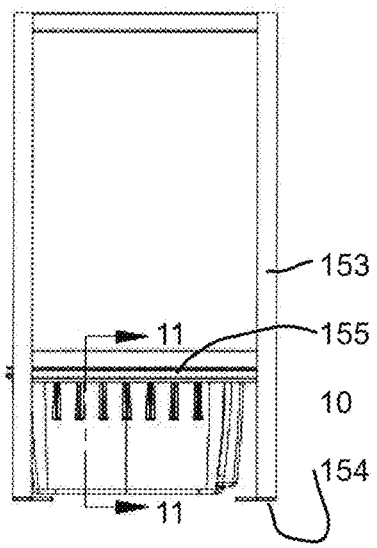
FIG. 10 is an end elevation view of the second embodiment.

Referring to FIG. 10, bunk bed 153 may hold box 10 suspended off floor 154 by box rails 155 engaging box 10. Bed platform 253 may have a bottom surface 157. Box rails 155 are attached by fasteners to bottom surface 157 and disposed to slidingly receive the respective first and third vertical box flanges 88, 98 on opposing sides 14, 114 of box 10.

Figure 11:
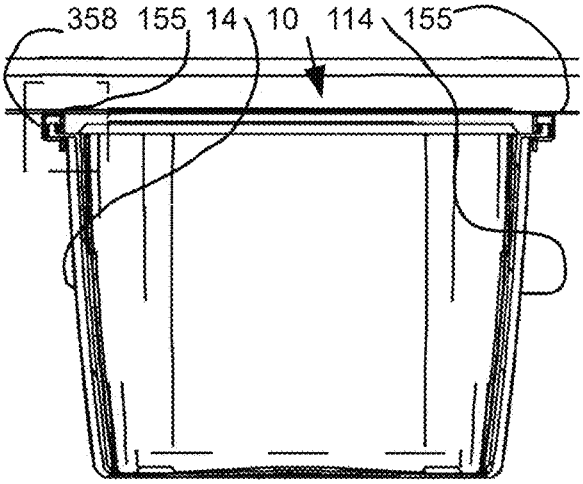
FIG. 11 is a section view taken at approximately 11-11 of FIG. 10.

Referring to FIG. 11, box 10 is hung from box edge rails 155 having vertical surround flange 358 surrounding box 10 on two opposing sides 14, 114.

Figure 12:
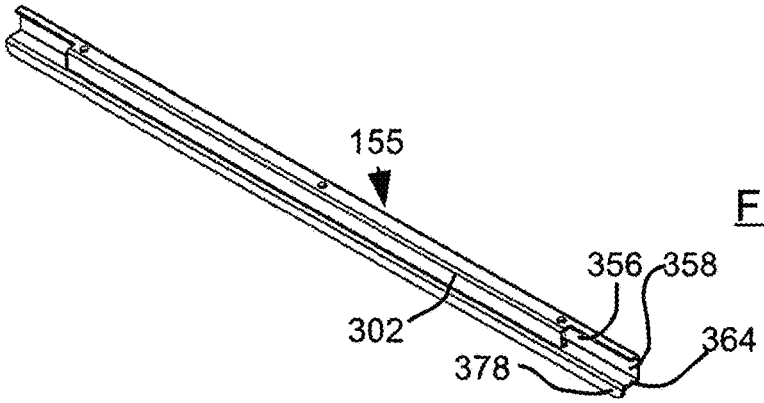
FIG. 12 is a perspective view of the channel of the second embodiment.

Referring to FIG. 12, box edge rail 155 has vertical surround flange 358 on outside engaging horizontal box flange 88 on the outside edge 70. Horizontal surround flange 364 engaged to and bearing against bottom 73 of horizontal box flange 68 and rib 302 extending downward into box opening 32 to engage inside edge of vertical box flange.

Figure 13:
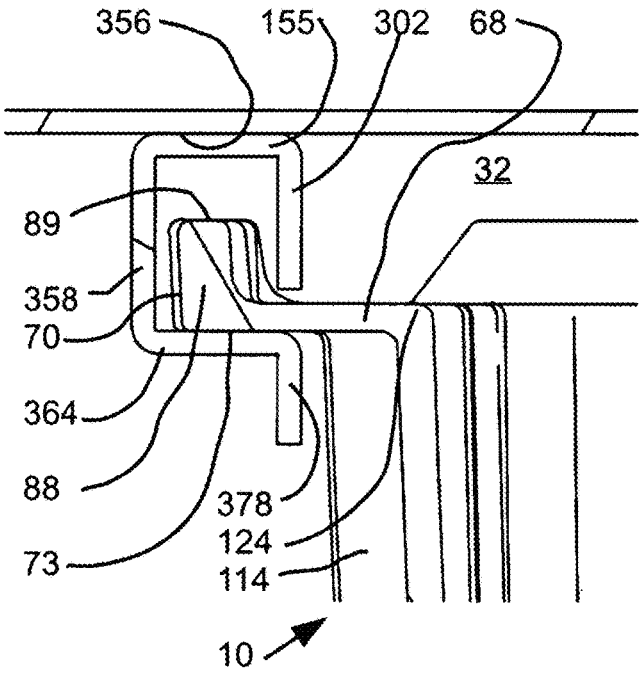
FIG. 13 is a section view taken at approximately 9-9 of FIG. 8.

Referring to FIG. 13, each box edge rail 155 is attached to bottom side 356 to engage box 10 along vertical box flanges 88, 98 (FIG. 5). Box opening 32 is closed by box edge rails 155 holding box 10 having vertical surround flange 358 on outside engaging horizontal box flange 88 on the outside edge 70. Horizontal surround flange 364 engaged to and bearing against bottom 73 of horizontal box flange 68 and rib 302 extending downward into box opening 32 to engage inside edge of vertical box flange 88. Top edge 89 bearing against lid bottom 356. Supplemental horizontal surround flange 378 may be adapted to bear against second side 114. The lid bottom 356 bears against the vertical box flange to close the box opening 32.

Figure 14:
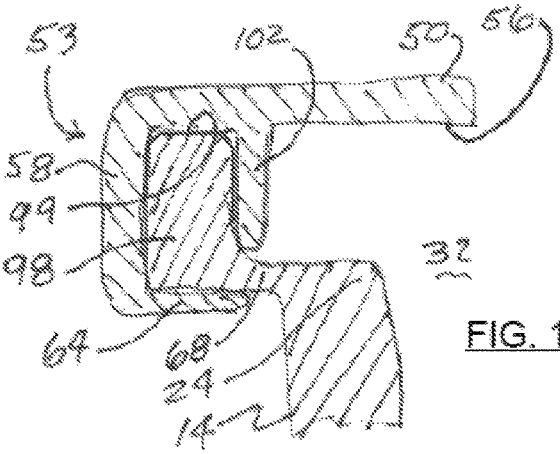
FIG. 14 is a section view taken at approximately 14.14 of FIG. 5.

Referring to FIG. 14, lid 50 may have edge rail 55 integrally formed on lid bottom 56 along first side 14. First horizontal box flange 68 extends outwardly from box opening 32 adjacent to first top edge 24. First vertical box flange 98 may be disposed between first rib 102 and first vertical surround flange 58. Likewise, first vertical box flange 98 may be disposed between lid bottom 56 and first horizontal surround flange 64. top edge 99 of first vertical box flange 98 bears against lid bottom 56 between first rib 102 and first vertical surround flange 58.

While the invention has been described with reference to exemplary embodiments, it should be understood by those skilled in the art that various changes may be made and equivalents may be substituted for elements thereof without departing from the scope of the invention. For example, certain ranges, limits, settings, and other such parameters may be modified to further implement the teachings herein. In addition, many modifications may be made to adapt a particular situation or substance to the teachings of the invention without departing from the scope thereof.

I claim:

1. A storage box having a generally rectangular bottom panel, a first and second sidewall, a first and second end wall, and a top edge surrounding a box opening, the box comprising:

a horizontal box flange on the top edge, the horizontal box flange extending outwardly from the box opening, the horizontal box flange surrounding the box opening;

a first vertical box flange on the horizontal box flange adjacent the first sidewall, the first vertical box flange extending upwardly away from the box opening, the first vertical box flange having a generally rectangular shape comprising a top, an outer side, an inner side and a bottom, the bottom on the horizontal box flange, the outside and inside on the bottom, the outside and the inside on the top;

a lid removably on the box, the lid comprising a first rail, a lid bottom, a first side and a second side, the first rail on the lid bottom adjacent first side, the first rail surroundingly engaged to the first vertical box flange whereby the rail has opposing sides to surround the first vertical box flange, the lid bottom bearing against the first vertical box flange top; and a first rib on the lid bottom, the first rib spaced from the first vertical surround flange, a rib channel between the first rib and the first vertical surround flange, the first vertical box flange in the rib channel, with the horizontal box flange disposed between the first horizontal surround flange and the lid bottom.

2. The storage box of claim 1, further comprising a second vertical surround flange on the lid, and a second vertical box flange on the horizontal box flange, the second vertical box flange adjacent the second sidewall, the second vertical box flange spaced from the first vertical box flange, the second vertical box flange generally parallel to the first vertical box flange, the second vertical surround flange bearing against the second vertical box flange, the second vertical box flange between the second vertical surround flange and the box opening, a second horizontal surround flange on the vertical surround flange extending toward the first horizontal surround flange, the second vertical box flange extending upward from the horizontal box flange, the second vertical box flange bearing against the second vertical surround flange, the second vertical box flange between the lid bottom and the second horizontal surround flange.

3. The storage box of claim 2, further comprising a second rib on the lid bottom, the second rib spaced from the second vertical surround flange, the second vertical box flange between the second vertical surround flange and the second rib.

4. The storage box of claim 3, wherein the first rib further comprises a first plurality of tabs attached to the lid bottom, the first plurality of tabs aligned parallel to the first vertical surround flange, the first plurality of tabs spaced from the first vertical surround flange.

5. The storage box of claim 4, wherein the second rib further comprises a second plurality of tabs attached to the lid bottom, the second plurality of tabs aligned in a second linear orientation, the second linear orientation parallel to the second plurality of tabs.

6. The storage box of claim 5, wherein the lid comprises a shell adapted to fit over the box opening, the shell having a plurality of bosses formed on the top side, the bottom panel further comprising a plurality of indentations formed therein.

7. The storage box of claim 3, wherein the first vertical surround flange is integrally molded to the lid bottom.

8. The storage box of claim 3, wherein the lid further comprises a first end between the first side and the second side, a third vertical surround flange on the lid bottom, the third vertical surround flange on the first end, a third horizontal box flange on the second tapered endwall, the third horizontal box flange between the third horizontal surround flange and the lid bottom.

9. The storage box of claim 2, the lid further comprising a third vertical surround flange on the lid bottom and the box further comprising a third vertical box flange on the horizontal box flange adjacent the first endwall, the third vertical surround flange, a third horizontal surround flange on the third vertical surround flange, the third horizontal surround flange bearing against the horizontal box flange.

10. The storage box of claim 9 wherein the third vertical surround flange is connected to the first vertical surround flange and the second vertical surround flange whereby the lid bottom is surrounded on the first and second sides and the first end by the connected first, second and third vertical surround flanges.

11. The storage box of claim 9, further comprising a fourth vertical box flange adjacent the first box end wall, the fourth vertical box flange spaced from the first vertical box flange, the fourth vertical box flange spaced from the second vertical box flange.

12. The storage box of claim 2, wherein the lid further comprises a handle, a top side, a padlock hole, a plurality of bosses on the top side, a third vertical surround flange on the lid, a third horizontal surround flange on the third vertical surround flange, the third horizontal surround flange bearing against the horizontal box flange adjacent the box second end wall.

13. The storage box of claim 12, further comprising a fourth vertical box flange adjacent the first box end wall, the fourth vertical box flange spaced from the first vertical box flange to form a rib channel on the horizontal box flange.

14. The storage box of claim 1, wherein the first rib further comprises a first plurality of tabs attached to the lid bottom, the first plurality of tabs aligned in a linear orientation, the linear orientation parallel to the first vertical surround flange.

15. The storage box of claim 1, further comprising a flange channel in the lid, the flange channel adapted to surroundingly receive the first horizontal box flange.

16. The storage box of claim 1 wherein the first horizontal box flange surrounds the box opening, the lid further comprises a second rail, the second rail disposed to surroundingly engage the horizontal box flange adjacent second tapered sidewall, a locking hole in the lid and the first horizontal surround flange.

17. A storage box having a generally rectangular bottom panel, a first and a second tapered sidewall, a first and a second tapered endwall and a box opening, the first tapered sidewall having a bottom edge on the bottom panel and a first top edge spaced from the bottom panel, the second tapered sidewall having a second bottom edge on the bottom panel and a second top edge spaced from the bottom panel, the first tapered sidewall attached to the first and second tapered endwalls, the second tapered sidewall attached to the first and second tapered endwalls, the first tapered sidewall spaced from the second tapered sidewall, the first and second tapered sidewalls and first and second tapered endwalls forming a top edge, the top edge surrounding the box opening, the box opening spaced from the bottom panel, the storage box comprising:

a first horizontal box flange on the top edge, the first horizontal box flange having a top, a bottom and an outer edge, the bottom on the top edge, the outer edge spaced from top edge the flange top edge spaced vertically from top edge, the first horizontal box flange extending outwardly surrounding the box opening;

a first vertical flange, the first vertical flange on the first horizontal box flange, the first vertical flange adjacent the first tapered sidewall, the first vertical flange spaced from the box opening, the first vertical flange comprising a top edge, the first vertical box flange extending upwardly away from the box opening; and a lid on the box, the lid comprising a top, a bottom, a first side and a second side and a first rail, the first rail on the lid bottom, the first rail comprising a first vertical surround flange adjacent the first side, and a first rib spaced from the first vertical surround flange, a channel on the lid bottom between the first vertical surround flange and the first rib, a horizontal surround flange on the first vertical surround flange, the horizontal surround flange spaced from the lid bottom, the first vertical surround flange bearing against the outer edge, the upper edge channel bearing against the flange top edge, the horizontal surround flange bearing against the horizontal box flange bottom, whereby the first horizontal box flange is disposed between the first rib and the horizontal surround flange, the first rail on the first side.

18. The storage box of claim 17, wherein the box further comprises a second vertical box flange on the outer edge, the second vertical box flange adjacent the second tapered sidewall, the lid further comprising a second rail on the lid bottom adjacent the second side, the second rail spaced from the first rail, the second rail comprising a second rib and a second vertical surround flange, the rib bearing against the second vertical box flange, the second vertical surround flange bearing against the second vertical box flange, a second horizontal surround flange on the second vertical surround flange, the second horizontal surround flange spaced from the lid bottom, the horizontal box flange between the second rib and the second horizontal surround flange, the top edge bearing against the lid bottom, the outer edge bearing against the second vertical surround flange, the horizontal box flange bottom on the second horizontal surround flange, the second rib bearing against the horizontal box flange, the first rail generally parallel to the second rail.

19. The storage box of claim 18, wherein the lid further comprises a first end, a third vertical surround flange on the first end, the third vertical surround flange on the lid bottom, the third vertical surround flange bearing against the outer edge.

20. The storage box of claim 19, the lid further comprising a top, a second end, a padlock opening and a support rib, the padlock opening in the second end, the padlock opening extending from the lid top to the lid bottom, the support fin on the lid top, the support fin spaced from the padlock opening, the box further comprising a box padlock aperture in the horizontal box flange, wherein the lid engages the horizontal box flange adjacent the first side, the second side and the first end, the first vertical surround flange is attached to the third vertical surround flange, the second vertical surround flange is attached to the third vertical surround flange.

21. A storage box having a generally rectangular bottom panel, a box opening, a first and second tapered sidewall, and a first and second tapered endwall, the first and second sidewalls and the first and second endwalls on the bottom panel to form a box with a box opening, the box opening surrounded by a top edge, the storage box comprising:

a horizontal box flange, the horizontal box flange on the top edge, the horizontal box flange surrounding the box opening, the horizontal box flange comprising a bottom, an outer edge and a top, the bottom on the top edge, the outer edge spaced from the box opening;

a first vertical box flange, the first vertical box flange on the horizontal box flange top, the first vertical box flange adjacent to the first tapered sidewall, the first vertical box flange spaced from the first tapered sidewall, a second vertical box flange on the horizontal box flange, the second vertical box flange adjacent to the second tapered sidewall, the second vertical box flange on horizontal box flange top;

a lid, the lid covering the box opening, the lid comprising a top, a bottom, a first side, a second side, a first rail and a second rail, the first rail on the lid bottom adjacent the first side, the first rail adapted to surroundingly engage the first vertical box flange, the first rail comprising a first vertical surround flange on the lid bottom and a first rib, the first vertical flange top between the first vertical surround flange and the first rib, a first horizontal surround flange on the first vertical surround flange, the first horizontal surround flange spaced from the lid bottom, the first vertical box flange between the first horizontal surround flange and the horizontal box flange bottom, the second rail comprising a second vertical surround flange on the lid bottom and a second rib, the second vertical box flange top between the second vertical surround flange and the second rib, a second horizontal surround flange on the second vertical surround flange, the second horizontal surround flange spaced from the lid bottom, the second vertical box flange between the second horizontal surround flange and the horizontal box flange bottom.

* * * * *